United States Patent [19]

Kleimeyer et al.

[11] Patent Number: 4,600,434

[45] Date of Patent: Jul. 15, 1986

[54] PROCESS FOR DESULFURIZATION OF FERROUS METAL MELTS

[75] Inventors: David L. Kleimeyer, Russell; Larry N. Fletcher; Alan D. Stacy, both of Ashland, all of Ky.; Allan M. Smillie, Middletown, Ohio

[73] Assignee: Armco Inc., Middletown, Ohio

[21] Appl. No.: 758,516

[22] Filed: Jul. 24, 1985

[51] Int. Cl.[4] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,998,625 | 12/1976 | Koros | 75/53 |
| 4,040,818 | 8/1970 | Clegg | 75/58 |
| 4,209,325 | 6/1980 | Cooper | 75/58 |
| 4,286,984 | 9/1981 | Luyckx | 75/58 |

FOREIGN PATENT DOCUMENTS 9129709 7/1984 Japan .

*Primary Examiner*—Peter D. Rosenberg

*Attorney, Agent, or Firm*—Frost & Jacobs

[57] ABSTRACT

A process for magnesium desulfurization of ferrous metal melts in a vessel comprising the provision of a fluid, high sulfur capacity slag wherein the weight ratio of slag constituents associated with sulfur to slag constituents associated with oxygen is greater than 0.8, followed by addition of magnesium to the melt in an amount sufficient to combine with the sulfur in the melt, transfer to the sulfur removed by the magnesium addition to the slag, and retention of the removed sulfur in the slag, thereby improving magnesium desulfurization efficiency and substantially eliminating sulfur reversion from the slag back to the melt.

24 Claims, 3 Drawing Figures

PROCESS FOR DESULFURIZATION OF FERROUS METAL MELTS

BACKGROUND OF THE INVENTION

This invention relates to magnesium desulfurization of molten ferrous metal by a novel process which achieves maximum magnesium desulfurization efficiency and substantial elimination of sulfur reversion from a slag back to the molten metal during casting thereof. Although not so limited the invention has particular utility in desulfurizing molten cast iron from a blast furnace prior to charging into an oxygen steel converter such as a basic oxygen furnace (BOF). The specification for steel produced in a BOF is presently 0.015% maximum sulfur.

In a typical system for such an operation molten cast iron is tapped into a transfer vessel such as a torpedo (or bottle) car. The metal flows through open runners from the blast furnace into the car, and some furnace slag is usually carried into the car. After the car is filled, it may be moved to a desulfurization station where desulfurizing agents are injected into the molten metal. The car is then transported to another station where it is emptied into a ladle. Slag is skimmed from the ladle, and the melt is then charged into a BOF.

Alternatively, the torpedo car may be moved after filling directly to a ladle station, and desulfurization may be conducted in a ladle after the car is emptied into it.

Cast iron made in a blast furnace has a silicon content within the range of about 0.5% to about 1.5% and sulfur about 0.02% to about 0.1%. Some of the silicon oxidizes to silica (silicon dioxide) in the open runners during tapping. The refractory used in the runners is usually silica, some of which erodes and is carried into the torpedo car, where it becomes part of the slag. Accordingly, even though the blast furnace slag which is carried into the car initially has a high sulfur capacity, the additional silica which gets into the slag during tapping normally causes the final slag cover, after the car is filled, to have a low sulfur capacity.

A major problem in the prior art practice described above is removal of all the cover slag when the torpedo car is emptied into the ladle. Even if the car can be rotated 180°, some slag solidifies and sticks to the inner walls of the car. If desulfurization has been conducted in the car, the slag has a high sulfur content, and this carry-over slag thus contaminates the next charge of molten cast iron when the car is returned to the blast furnace and refilled.

Sulfur reversion can thus result from the carry-over slag in the torpedo car. In practice, excess magnesium must be added to remove this sulfur. In addition, the problem of sulfur reversion can occur after desulfurization either in the car or ladle if the slag has a low sulfur capacity. This is the case when the slag is already high in sulfur as a result of carry-over slag in the car.

In conventional practice, the problems outlined above result in uncertainty regarding the amount of sulfur in the carry-over slag. This uncertainty in turn makes it difficult to predict accurately the amount of magnesium which should be added for desulfurization. Accordingly, heats having unacceptably high sulfur are produced relatively frequently, and these must be reblown in the BOF with consequent added processing cost. The alternative of adding magnesium substantially in excess of the predicted amount also increases costs and can lead to processing difficulties resulting in lower yields.

U.S. Pat. No. 4,341,554, issued July 27, 1982 to P. J. Koros et al, discloses a process for desulfurizing molten steel which comprises covering the melt with a synthetic slag layer, adding particulate lime to cover the synthetic slag, the lime being of a size such that substantially all is retained on a No. 80 sieve, injecting powdered lime into the melt along with a desulfurizing agent which vaporizes under the pressure and temperature conditions within the melt, and permitting the powdered lime to rise to the surface of the melt and form together with the particulate lime a crust which deters entry of ambient air into the melt. Preferred desulfurizing agents are magnesium and calcium silicon. The purpose of adding a particulate lime cover and for injecting powdered lime along with the desulfurizing agent is to eliminate the need for a mechanical cover over the ladle.

U.S. Pat. No. 4,374,664, issued Feb. 22, 1983 to T. Mitsuo et al, discloses a process for desulfurization of molten pig iron by addition of aluminum powder and lime, alumina or both, whereby to reduce the splashing associated with the addition of aluminum alone. The amount of aluminum added is sufficient to result in an aluminum content in the pig iron in weight percent of 0.01–0.1 times the concentration of silicon in the molten pig iron plus 0.2–1.0 times the concentration of sulfur in weight percent to be removed from the molten pig iron. The addition of aluminum prior to desulfurization is alleged to be for the purpose of improving the poor desulfurization efficiency of lime by preventing formation of high melting point shells of calcium silicate on the surfaces of the lime particles, derived from the silicon in the molten pig iron which is oxidized on the surfaces of the lime particles.

R. C. Sussman and A. M. Smillie presented a paper at the Chinese Iron and Steel Society Conference on Injection Metallurgy, Shanghai, China, Nov. 1, 1982, entitled "Progress In Hot Metal And Steel Desulfurization By Injection At Armco". This article summarizes the prior practice of injection of lime and magnesium for desulfurization of blast furnace iron and the difficulties resulting from this practice at lime-to-magnesium ratios ranging from 10:1 to 4:1. These difficulties resulted in elimination of lime from the process and use of magnesium alone as a desulfurization agent. The importance of draining torpedo cars in order to prevent sulfur reversion on the next cast is mentioned.

A paper was presented by A. M. Smillie and R. A. Huber in March 1979 to the 62nd National Open Hearth and Basic Oxygen Steel Conference entitled "Operating Experience At Youngstown Steel With Injected Salt Coated Magnesium Granules For External Desulfurization Of Hot Metal". This paper summarizes data from a mill indicating that the sulfur content of hot metal received by the steel plant was about 0.008% higher than the cast analysis and that samples of carry-over slag taken from the transfer ladle revealed a great decrease in both sulfur content and base:acid ratio. The sulfur reversion problem is thus recognized, and further data are given indicating an increase in efficiency by use of salt coated magnesium granules instead of magnesium coke and 75% magnesium–25% aluminum powder used previously.

A lecture was given by A. M. Smillie at McMaster University, Hamilton, Canada, in May 1984 entitled "External Treatment Of Hot Metal". This summarizes prior art processes, equipment and desulfurizing agents. Advantages and disadvantages of the various injection processes are discussed.

An article by O. Haida et al entitled "Injection Of Lime Base Powder Mixtures To Desulfurize Hot Metal In Torpedo Cars" in *Proceedings of Scaninject II,* pp 20:1-20 (June, 1980), discusses replacement of a calcium carbide desulfurization process by a lime desulfurization process. The problem of high sulfur in the carry-back slag in the torpedo car is recognized, and this is stated to amount to about 0.008% to 0.010% sulfur reversion when using the calcium carbide process. However, when using the lime process, desulfurization (i.e., negative sulfur reversion) was obtained on the order of 0.002%-0.003% sulfur. The expedient of completely deslagging a torpedo car, with consequent saving in carbide consumption, is stated to be more than counterbalanced by the labor costs and metal loss inherent in deslagging. Accordingly, even with the alleged improvement achieved with lime desulfurization, the torpedo car slag contains about 4% sulfur before desulfurization, compared to a blast furnace slag sulfur content of about 1%. There is thus no recognition in this article of the benefit to be derived from providing a fluid, high sulfur capacity slag in a transfer vessel, prior to desulfurization.

Other prior art of which applicants are aware disclose the use of aluminum, magnesium and/or lime as a desulfurizing agent.

Despite the above-discussed modifications in processing and equipment, there is still a need to minimize sulfur reversion, to increase magnesium efficiency, to improve the end point predictability of magnesium injection and to improve yields.

SUMMARY OF THE INVENTION

It is an object of the present invention to provide a process of desulfurizing a molten ferrous metal charge which overcomes the problems of sulfur reversion and removal of substantially all the slag from a torpedo car after it is emptied.

It is a further object of the invention to provide a process for desulfurization of ferrous metal melts achieving the advantages hereinafter set forth.

The weight ratio of those slag constituents or species associated with sulfur to those constitutents or species associated with oxygen is defined herein as the sulfur capture ratio. The primary species normally found in iron-making slag which are associated with sulfur are CaO and MnO, while the primary species normally associated with oxygen are $SiO_2$, $Al_2O_3$ and MgO. It should be noted that in conventional base:acid ratios MgO is considered to be associated with sulfur (i.e. in the numerator), whereas in the present definition of sulfur capture ratio MgO is in the denominator. As explained hereinafter, this is based on a discovery that MgS formed in the molten iron dissociates at the slag-metal interface. In actual commercial practice, the MnO content can be disregarded since it is low. Similarly, since both $Al_2O_3$ and MgO can be as low as 5% each, one of these species can also be disregarded for convenience in calculating the sulfur capture ratio during commercial operation. Accordingly, in its broadest aspect, the sulfur capture ratio is derived from % CaO/% $SiO_2$+% $Al_2O_3$ or % MgO. In a more accurate and preferred form the sulfur capture ratio is represented by % CaO +% MnO/% $SiO_2$ % $Al_2O_3$+% MgO.

Empirical data set forth below show that when the sulfur capture ratio is greater than 0.8, and preferably at least 1.0, the objectives of the invention are realized.

According to the invention, there is provided a process for magnesium desulfurization of a ferrous metal melt with improved efficiency in magnesium consumption and substantial elimination of sulfur reversion, comprising the steps of providing a flux in a transfer vessel into which said melt is tapped, said flux containing a calcium compound and at least one of aluminum, alumina, fluorspar and silica in proportions such that a fluid, high sulfur capacity slag is formed in said vessel after tapping in which substantially all said calcium compound is dissolved and wherein the weight ratio of slag constituents associated with sulfur to slag constituents associated with oxygen is greater than 0.8, thereafter injecting magnesium into said melt in an amount sufficient to desulfurize said melt by formation of magnesium sulfide particles, and causing the sulfur to be absorbed in and retained by said slag.

In one embodiment of the invention, a process is provided for desulfurizing a ferrous metal charge by magnesium addition prior to refining the charge in an oxygen steel converter, wherein the molten charge is tapped into a transfer vessel, emptied therefrom into a ladle for charging into the converter, a calcium compound is added to the charge, fluxing agents are added along with the calcium compound in an amount sufficient to dissolve the calcium compound and to form with silica in the charge a fluid, high sulfur capacity slag wherein the sulfur capture ratio is greater than 0.8, thereafter magnesium is added to the charge for desulfurization in one of the transfer vessel and the ladle, and sulfur removed from the charge by the magnesium addition is caused to be transferred to and retained by the slag.

DETAILED DESCRIPTION

Figure 1:
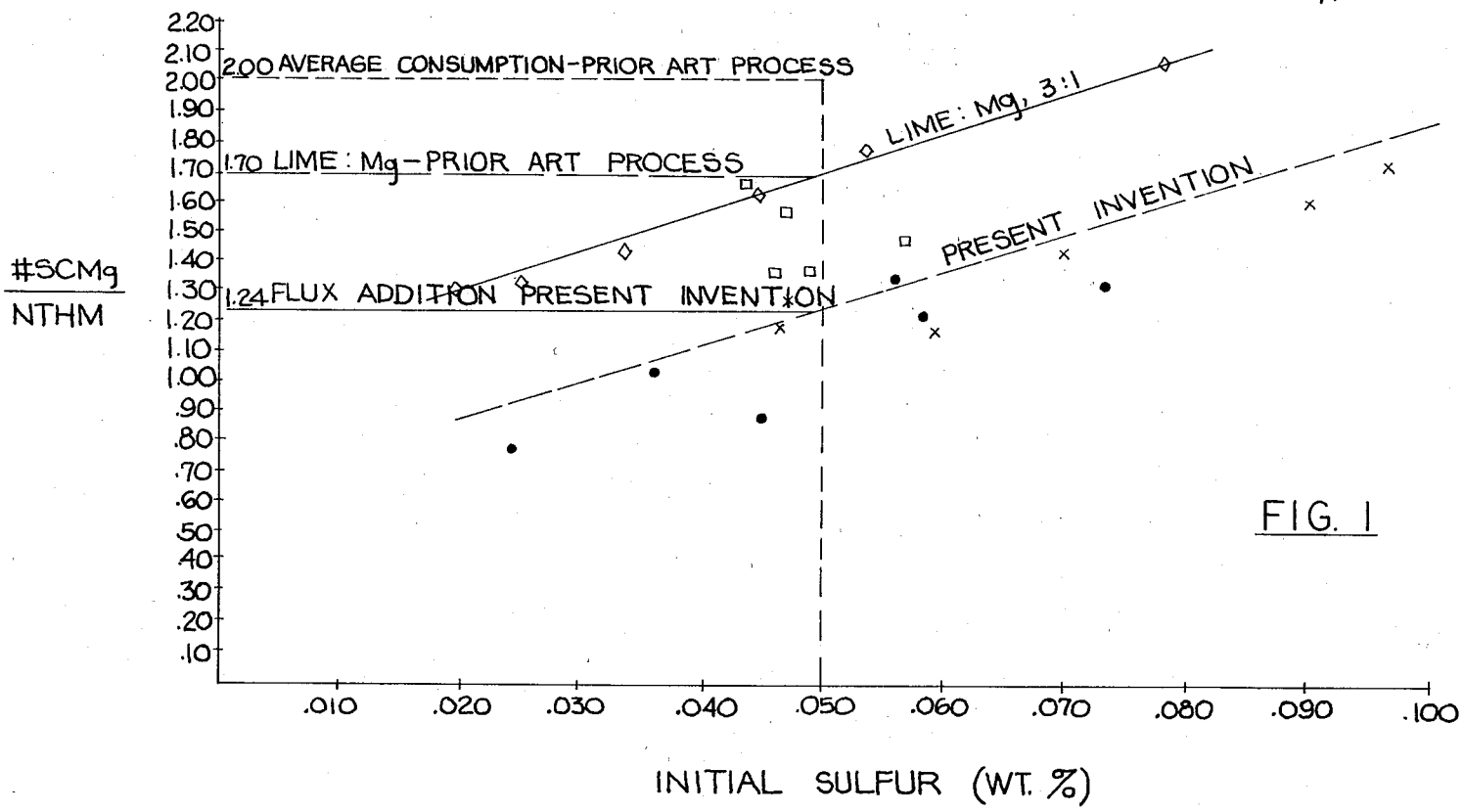
FIG. 1 is a graphic comparison of the amount of magnesium required in the process of the invention against amounts required in two prior art processes, based on plant trials involving three different torpedo cars.

By way of further background, the prior art generally used lime in combination with magnesium as a desulfurizing agent. Lime alone is a poor desulfurizing agent since the slag volume becomes excessive, and the lime does not go into solution. The prior art processes therefore generally added fluidizing agents such as fluorspar in an attempt to dissolve the lime. However, even with this practice, lime tended to solidify and build up in the transfer car, thus increasing the amount of carry-back sulfur which reverted into the next charge. The assignee of applicants used the combined lime-magnesium injection system for several years but finally gave it up in favor of using magnesium alone as a desulfurizing agent. However, as described above, the use of magnesium alone did not solve the problems of sulfur reversion, improved efficiency and improved end point predictability.

An increase in the amount of blast furnace slag used in the transfer car or ladle is not effective in solving these problems since blast furnace slag does not provide a high S capacity nor the necessary low temperature fluidity.

The present invention represents the first successful solution to these problems.

When hot metal is desulfurized by injection of magnesium, solid particles of magnesium sulfide are formed, and these particles float to the surface of the molten metal. Applicants have found that the magnesium sulfide particles dissociate at the slag-metal interface, and the sulfur released thereby is absorbed by the slag, if it has adequate sulfur capacity. Slag analysis has determined that discrete magnesium sulfide is not present therein. Thus, the sulfur originally combined with magnesium is instead associated in the slag with calcium and manganese. It is therefore an important concept of the present invention to provide, prior to magnesium injection, the minimum quantity of fluid, high sulfur capacity slag needed to capture or absorb and retain the sulfur removed from the molten metal.

Where a torpedo car is used for transferring blast furnace cast iron to a ladle for subsequent refining in a BOF, the process of the invention involves the addition of a powdered flux mixture to the empty torpedo car prior to tapping or casting the molten cast iron therein. The flux mixture contains a calcium compound and at least one of aluminum, alumina, fluorspar and silica. The quantity and the composition of the flux addition is based on the approximate amount of silica entering the torpedo car during tapping due to oxidation of silicon in the runners and pick-up of silica from refractory materials. The composition will thus be variable in proportion to the amount of silica which will be in the car and generally will be within the ranges of about 60%–90% by weight calcium compound, up to 35% alumina, up to 15% fluorspar and up to about 5% silica. Suitable calcium compounds include lime, calcium carbonate, calcium fluoride, calcium chloride, limestone, dolomitic limestone, burnt dolomite, and mixtures thereof. If fluorspar (calcium fluoride) is added as part of the calcium compound, it will of course also satisfy the fluorspar addition needed for fluidity of the slag and dissolution of the calcium oxide.

Silica would not normally be added as part of the flux mixture unless the quantity of silica picked up during tapping or casting is too low to form a fluid slag at normal casting temperature.

The objective of the various additions is to obtain a final slag in the torpedo car after casting containing about 40%–55% calcium oxide in dissolved or molten form, about 5% to about 15% magnesium oxide, about 5% to about 12% alumina, about 20% to about 35% silica, and small amounts of manganese oxide and alkali metal oxides. The sulfur capture ratio of percent calcium oxide (dissolved) plus percent manganese oxide/percent alumina plus percent silica plus percent magnesium oxide is greater than 0.8 and preferably greater than 1.0.

The quantity of flux utilized is kept to the minimum necessary to capture and retain all the sulfur transferred from the blast furnace cast iron. The quantity of flux ranges broadly from about 2 to 20 lbs. (1–10 kg) per net ton of molten metal, and preferably about 3 to 5 lbs. per net ton. (1.5–2.5 kg. ton)

The amount of fluorspar in the flux mixture is preferably restricted to the minimum needed to obtain a fluid slag after magnesium injection, in order to minimize erosion of the refractory in the torpedo car.

Although it is preferred to make the flux addition into the empty torpedo car before casting or teeming, part or all of the flux addition may be added to the car during casting, in which case it is preferably introduced into the hot metal stream before the car is half full. It is also considered to be within the scope of the invention to inject a minor portion of the flux mixture along with the magnesium, in order to reduce the carrier gas flow rate and to decrease the violence of the injection step.

Metallic aluminum additions may be made to the molten metal in order to attain a dissolved (i.e., acid soluble) aluminum content of at least 0.01%, and preferably about 0.025% in the metal prior to magnesium injection for desulfurization since it is believed that the Mg efficiency can be further improved by reducing the oxygen content of the iron bath. Thus, less Mg is lost to oxidation during injection.

In addition to adding a small amount of aluminum to the molten metal to reduce dissolved oxygen, it may also be advantageous to further protect the molten metal by providing a non-oxidizing atmosphere above the surface of the slag. An inert gas such as $N_2$ may be injected into the molten iron using one or more lances to further distribute the aluminum added and reduce dissolved oxygen. Purging gas may also be introduced into the space between the top of the torpedo car and upper surface of the slag. Injecting at least 100 $ft^3$/min (3 $NM^3$/min) of $N_2$ for at least 5 minutes prior to introduction of the magnesium may further increase efficiency. Less magnesium would be oxidized and the amount of MgO in the slag would be reduced.

Figure 3:
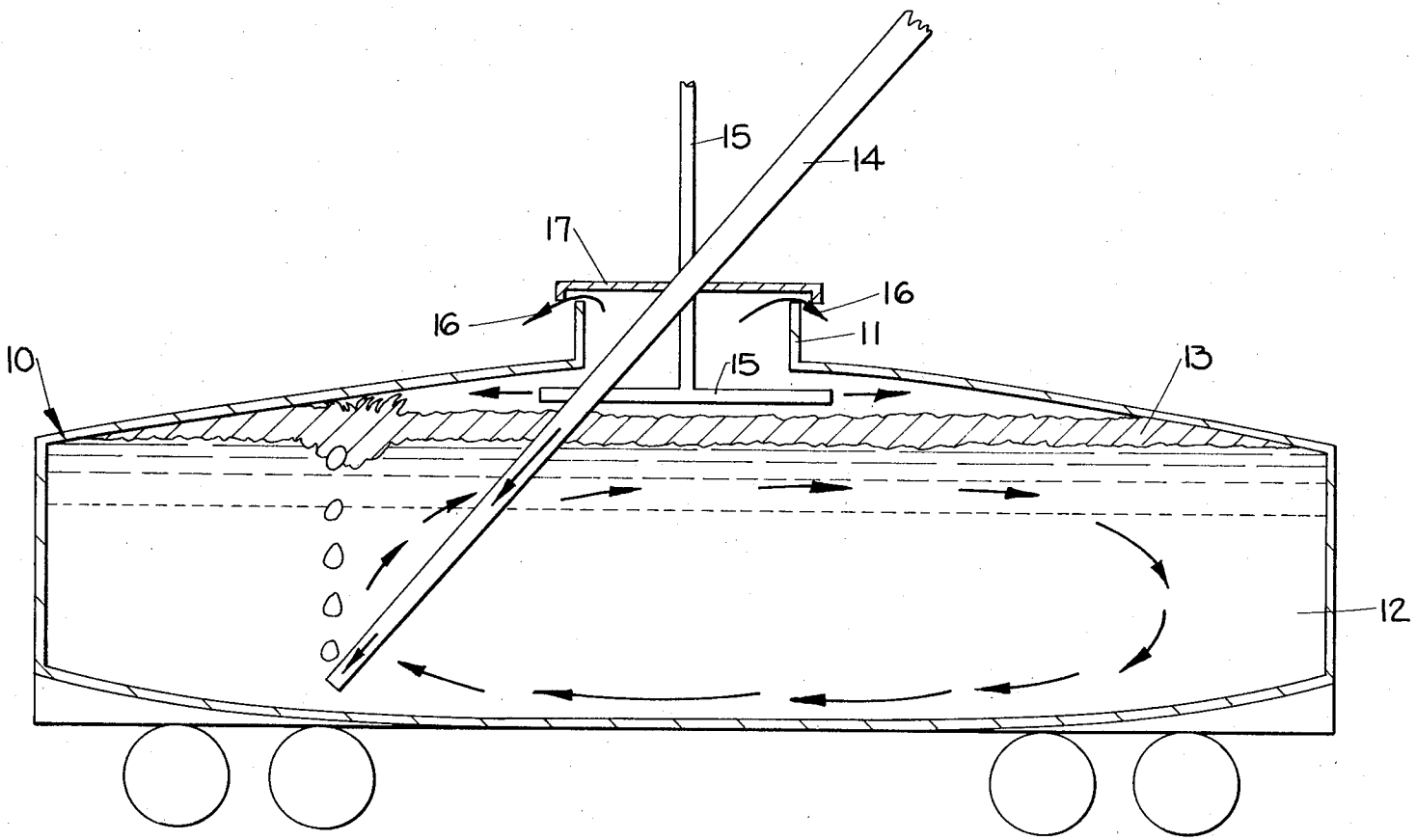

Apparatus for providing a non-oxidizing atmosphere is shown in FIG. 3 wherein a torpedo car is shown generally in vertical section at 10, the car being provided with a conventional charging mouth 11. Molten metal is shown at 12 and a slag cover at 13. Preferably aluminum is added to the molten metal, to achieve a dissolved aluminum content of about 0.025%, prior to charging into the torpedo car, and at least part of the slag constituents are charged before the hot metal. A lance 14 is inserted deep into the molten metal, and nitrogen is injected through the lance to effect thorough mixing of the molten metal and slag prior to the magnesium addition. As indicated above, a plurality of lances may be used in order to obtain a high flow rate. Nitrogen gas is additionally supplied from a source (not shown) through a conduit 15 to the space above the slag in the torpedo car 10. Air is expelled through the mouth as indicated by arrows 16. Preferably a flexible refractory mouth cover is provided as shown at 17 in order to minimize loss of nitrogen gas. The significance of the recognition that magnesium sulfide dissociates at the slag metal interface after magnesium injection is that the magnesium sulfide dissociation mechanism is the major rate controlling step. Hence adjustment of the slag composition by flux addition prior to magnesium injection optimizes the speed and efficiency of sulfur transfer from the molten metal to the slag.

The minimum sulfur capture ratio of 0.8 and preferred ratio of 1.0 is derived from the realization that normal equilibrium sulfur partitioning is not applicable when desulfurizing hot metal with magnesium. This makes it possible to observe only the minimum sulfur capture ratio rather than requiring a specific slag base:acid ratio or specific composition ranges in the final slag. The composition ranges of the slag set forth above are therefore to be considered as preferred rather than essential.

Restriction of the quantity of fluid slag to the minimum necessary for sulfur absorption and retention permits minimum metal yield loss.

The mechanism of sulfur removal by magnesium apparently occurs by the dissociation of magnesium sulfide as follows:

In hot metal $$\text{Mg (soln. in Fe)} + \text{S (soln. in Fe)} \rightarrow \text{MgS(prec.)} \quad (1)$$

which floats to the slag-metal interface and reacts $$\text{MgS (precipitate)} + \text{(Mn—Ca) slag complex} + \text{(Si—Al—O) slag complex} \rightarrow \text{(S—Mn—Ca) slag complex} + \text{(Mg—Si—Al—O) slag complex.} \quad (2)$$

The rate at which reaction (2) proceeds would determine the speed and efficiency of desulfurization.

Sulfur transfer by reactions (1) and (2) above has a valid foundation in sulfur removal theory. Sulfur transfer from molten iron to liquid slag is governed by the ionic transfer reaction in hot metal $$\text{S (iron)} + O^{2-}\text{(slag)} \rightarrow \text{O (iron)} + S^{2-}\text{(slag)} \quad (3)$$

where $$\log K = \log \frac{(a_{S^{2-}})\,[a_O]}{(a_{O^{2-}})\,[a_S]}. \quad (4)$$

The most favorable conditions for sulfur transfer exist when the activity of oxygen ions in the slag is high. Slags of high basicity (i.e., high CaO contents) possess high oxygen ion activity and hence are most favorable for sulfur transfer. In contrast to this, slags which are high in silica exhibit a very low slag oxygen ion activity because of the strong Si—$O^{2-}$bonding. Hence the conditions for sulfur transfer via reaction (3) above are very unfavorable. However, earlier work by others has shown that the oxygen ion activity of a high silica slag can be substantially increased under highly reducing conditions by the breakdown of the silicate structure:

$$2\,(\text{Si—O}^-) = (\text{Si—O—Si}) + O^{2-} \quad (5)$$

Under highly reducing conditions, a silica slag will then absorb sulfur by reaction (3). The stronger affinity of magnesium for oxygen than for sulfur provides the necessary reducing conditions for sulfur transfer by reactions (5) and (3). The slag products of reaction (2) have been confirmed by applicants by means of electron microprobe examination. Hence, the above conclusion appears to be confirmed.

Magnesium is preferably injected in the form of salt coated magnesium pellets, a product which is commercially available. The particle size of the powdered flux components is not critical and may be in the size ranges in which such ingredients are ordinarily sold. It will be understood that the desulfurizing reagent could include a mixture of magnesium (with or without a salt coating) and one or more of CaO, C, $CaC_2$, $CaF_2$ or other fluxing agents.

A plant trial was conducted using three ladle cars which were repeatedly fluxed and cycled only to the same BOF. These cars did not have large amounts of lime build-up therein prior to start of the test.

Each empty car was supplied with 1200 lbs. (545 kg) of a flux mixture, and the results are summarized in Table I. Average values for several of the variables for each car and for the overall trial are included at the bottom of Table I. The magnesium efficiency was calculated by the equation:

$$\%\ \text{Mg efficiency} = \frac{1516\ NTM\ [S_I\,(\text{wt }\%) - S_F\,(\text{wt }\%)]}{0.9\ (\text{lbs Mg injected})}$$

where NTM is net tons of molten metal, $S_I$ is the initial sulfur and $S_F$ is the final sulfur level.

Reference is next made to FIG. 1 where the overall average of 1.36 lbs (0.62 kg) of magnesium per NTM vs initial sulfur level is plotted for a final sulfur range of 0.005%-0.008%. This graph also shows the average consumption level of 2.00 lbs (0.91 kg) of magnesium per NTM for the preceding year using the prior art magnesium injection process, correlated to an average initial sulfur level of 0.050% and the same final sulfur level of 0.005%-0.008%. A straight line plot is shown approximating the earlier, abandoned lime-magnesium desulfurization process. It is evident that the process of the present invention represents a substantial decrease in the amount of magnesium per NTM as compared to both prior art processes.

In the above tests variations in the percent magnesium efficiency and magnesium consumption are a result of the dependency of these parameters on such variables as metal temperature, net tons of metal, injection efficiency, depth of lance, magnesium flow rate, mixing initial and final sulfur levels, and slag composition. For example, magnesium efficiency has been found to be inversely proportional to initial sulfur.

Table II shows the results of an additional trial using the flux process of the present invention as compared to heats outside the invention having a sulfur capture ("K") ratio less than 0.8. Column 6 shows the actual amount of Mg used. Column 8 shows the amount of Mg theoretically required as determined by the stoichiometric relationship, i.e. 100% efficiency. Column 10 shows the amount of Mg that would have been used in excess of the stoichiometric amount if the final sulfur had been reduced to 0.008%.

Unweighted averages of percent final sulfur and pounds of magnesium per net ton of molten metal in Table II are as follows:

| | % Final S | Lbs. Mg/NTM | (Kg Mg/NTM) |
|---|---|---|---|
| Present invention | 0.0074 | 1.12 | .51 |
| Outside invention | 0.0103 | 1.53 | .69 |

The slag analyses of the samples in Table II are shown in Table III along with calculated sulfur capture ("K") ratios.

Figure 2:
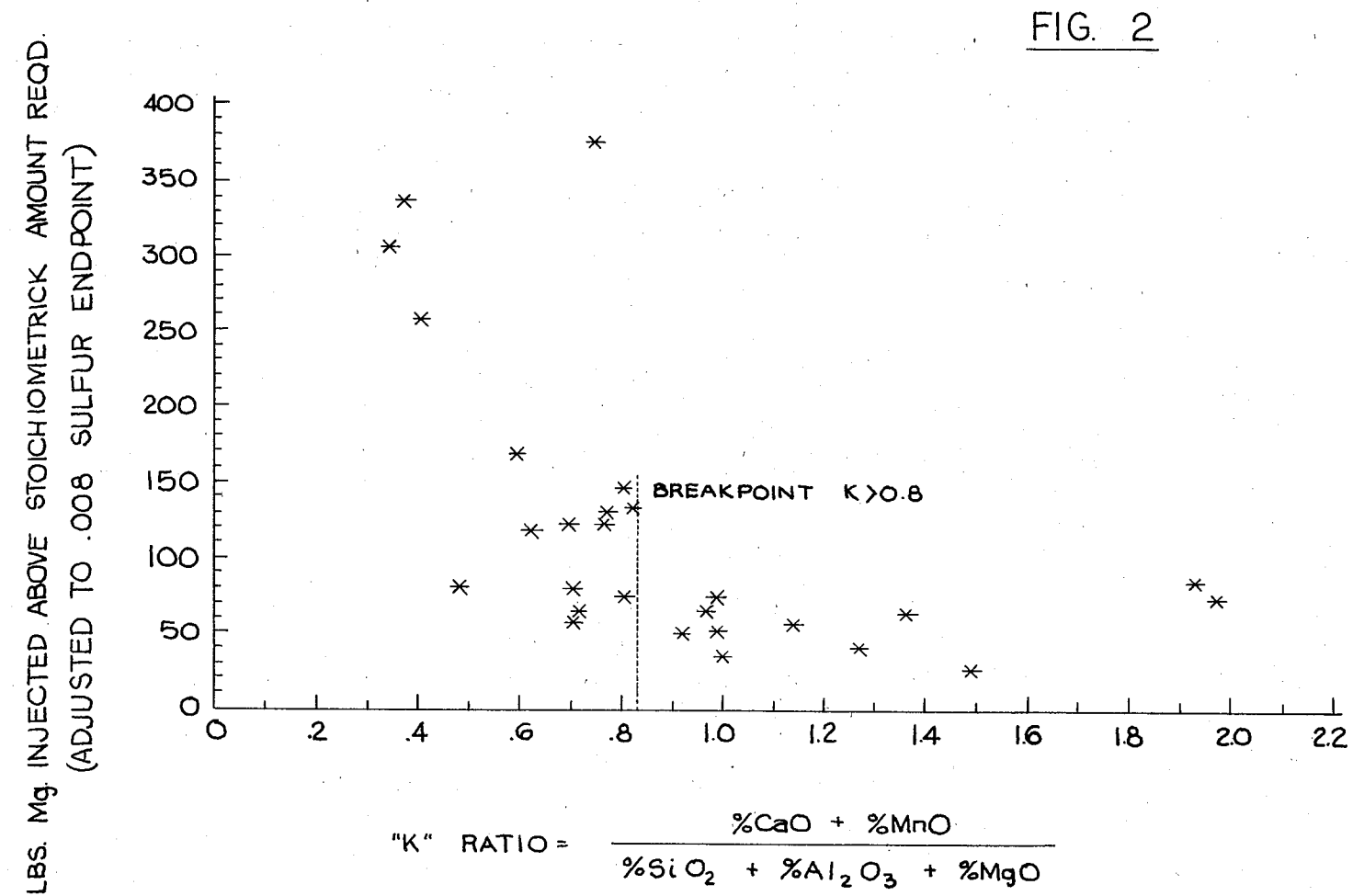
FIG. 2 is a graphic comparison of magnesium efficiency vs. slag composition; and, FIG. 3 is a diagrammatic illustration of apparatus for carrying out an embodiment of the invention.

FIG. 2 is a plot of the excess magnesium used from column 10 of Table II as a function of the sulfur capture ratio from Table III. As clearly shown in the graph, the magnesium efficiency is dramatically improved above a ratio of about 0.8.

TABLE I

Continuous Flux Addition Trial

| Consecutive Times Car Fluxed | NTM | (t) | Estimated Slag Weight (lbs) | Estimated Slag Weight (kgs) | % Initial Sulfur | % Final Sulfur | Mg Injected (lbs) | Mg Injected (kgs) | % Mg Effi-ciency | Mg per NTM (lbs) | Mg per NTM (kgs) | Average Injection Flow Rates: Mg per min. (lbs) | Mg per min. (kgs) | $N_2$ (SCFM) | $N_2$ ($M^3$) |
|---|---|---|---|---|---|---|---|---|---|---|---|---|---|---|---|
| First Car | | | | | | | | | | | | | | | |
| 1. | 168.5 | 153.2 | 6200 | 2815 | .056 | .008 | 226 | 103 | 60.3 | 1.34 | .61 | 18 | 8 | 155 | 4 |
| 2. | 159.0 | 144.5 | 7900 | 3585 | .036 | .005 | 165 | 75 | 50.3 | 1.04 | .47 | 20 | 9 | 120 | 3 |
| 3. | 113.5 | 013.2 | 4900 | 2225 | .024 | .006 | 90 | 41 | 38.2 | .79 | .36 | 28 | 13 | 124 | 4 |
| 4. | 162.5 | 147.7 | 15500 | 7035 | .073 | .006 | 218 | 99 | 84.1 | 1.34 | .61 | 34 | 15 | 100 | 3 |
| 5. | 160.5 | 145.9 | 15200 | 6900 | .044 | .007 | 160 | 73 | 70.3 | .89 | .40 | 27 | 12 | 119 | 3 |
| 6. | 164.0 | 149.1 | 19500 | 8850 | .037 | .003 | 176 | 80 | 53.4 | 1.07 | .49 | 28 | 13 | 106 | 3 |
| 7. | 173.5 | 157.7 | 7700 | 3495 | .058 | .009 | 210 | 95 | 68.2 | 1.21 | .35 | 23 | 10 | 127 | 4 |
| 8. | 175.0 | 159.1 | 2700 | 1225 | .055 | .004 | 195 | 89 | 77.1 | 1.11 | .50 | 22 | 10 | 119 | 3 |
| Second Car | | | | | | | | | | | | | | | |
| 1. | 157.0 | 142.7 | NA | | .090 | .008 | 252 | 114 | 86.0 | 1.60 | .73 | 15 | 7 | 150 | 4 |
| 2. | 150.5 | 136.8 | 15800 | 7175 | .046 | .008 | 178 | 81 | 54.1 | 1.18 | .54 | 26 | 12 | 123 | 4 |
| 3. | 152.5 | 138.6 | 4200 | 1905 | .047 | .006 | 196 | 89 | 53.7 | 1.28 | .58 | 28 | 13 | 125 | 4 |
| 4. | 164.0 | 149.1 | 20000 | 9080 | .097 | .006 | 280 | 127 | 89.8 | 1.71 | .78 | 30 | 14 | 116 | 3 |
| 5. | 171.0 | 155.4 | 2700 | 1225 | .059 | .006 | 202 | 92 | 75.6 | 1.18 | .54 | 24 | 11 | 116 | 3 |
| 6. | 169.0 | 153.6 | 19500 | 8850 | .071 | .003 | 300 | 136 | 64.5 | 1.78 | .81 | 29 | 13 | 112 | 3 |
| 7. | 142.5 | 129.5 | 8300 | 3770 | .070 | .006 | 202 | 92 | 76.0 | 1.42 | .64 | 18 | 8 | 120 | 3 |
| 8. | 112.5 | 102.3 | 9900 | 4495 | .047 | .002 | 271 | 123 | 31.5 | 2.41 | 1.09 | 21 | 10 | 118 | 3 |
| Third Car | | | | | | | | | | | | | | | |
| 1. | 163.0 | 148.2 | 3100 | 1405 | .057 | .005 | 242 | 110 | 59.0 | 1.48 | .67 | 16 | 7 | 142 | 4 |
| 2. | 163.0 | 148.2 | 4700 | 2130 | .035 | .004 | 188 | 85 | 45.3 | 1.15 | .52 | 30 | 14 | 120 | 3 |
| 3. | 177.5 | 161.4 | 6100 | 2770 | .054 | .003 | 220 | 100 | 69.3 | 1.24 | .56 | 31 | 14 | 113 | 3 |
| 4. | 154.0 | 140.0 | 4200 | 1950 | .048 | .005 | 210 | 95 | 53.1 | 1.36 | .62 | 18 | 8 | 101 | 3 |
| 5. | 164.0 | 149.1 | 6200 | 2815 | .046 | .006 | 224 | 102 | 49.3 | 1.36 | .62 | 28 | 13 | 109 | 3 |
| 6. | 116.5 | 105.9 | 12400 | 5630 | .047 | .008 | 182 | 83 | 42.0 | 1.56 | .71 | 18 | 8 | 110 | 3 |
| 7. | 95.5 | 86.8 | 11800 | 5360 | .043 | .005 | 160 | 73 | 38.2 | 1.67 | .76 | 21 | 10 | 118 | 3 |
| Averages | | | | | | | | | | | | | | | |
| First Car | 162.0 | 147.3 | | | .048 | .006 | 180 | 82 | 62.7 | 1.10 | .50 | | | | |
| Second Car | 152.0 | 138.2 | | | .066 | .006 | 235 | 107 | 66.4 | 1.57 | .71 | | | | |
| Third Car | 148.0 | 134.5 | | | .047 | .005 | 204 | 93 | 50.9 | 1.40 | .64 | | | | |
| Overall Averages | 154.0 | 140.0 | | | .054 | .006 | 206 | 94 | 60.0 | 1.36 | .62 | | | | |

TABLE II

Desulfurization Station Injection Data

| Heat | NTM | t | Hot Metal Wt. % Initial Sulfur | Hot Metal Wt. % Final Sulfur | SCMg Injected (lbs) | SCMg Injected (kgs) | Contained Mg (lbs) | Contained Mg (kgs) | Mg per NTM (lbs) | Mg per NTM (kgs) | Required Stoichio-metric Mg (lbs) | Required Stoichio-metric Mg (kgs) | Mg Over STK Injected (lbs) | Mg Over STK Injected (kgs) | .008S Endpoint Adjusted Mg Over STK Injected (lbs) | .008S Endpoint Adjusted Mg Over STK Injected (kgs) |
|---|---|---|---|---|---|---|---|---|---|---|---|---|---|---|---|---|
| 1* | 180.6 | 164.2 | .060 | .004 | 252 | 114 | 227 | 103 | 1.26 | .57 | 153 | 69 | 74 | 34 | 29 | 13 |
| 2* | 184.0 | 167.3 | .038 | .004 | 198 | 90 | 178 | 81 | 0.97 | .44 | 95 | 43 | 38 | | | |
| 3* | 167.4 | 152.2 | .072 | .007 | 240 | 109 | 216 | 98 | 1.29 | .59 | 165 | 75 | 51 | 23 | 41 | 19 |
| 4* | 227.6 | 209.0 | .025 | .005 | 171 | 78 | 154 | 70 | 0.68 | .31 | 69 | 31 | 85 | 39 | 50 | 23 |
| 5* | 229.7 | 208.9 | .045 | .008 | 200 | 91 | 180 | 82 | 0.78 | .35 | 129 | 59 | 51 | 23 | 51 | 23 |
| 6* | 181.2 | 164.8 | .053 | .008 | 198 | 90 | 178 | 81 | 0.98 | .44 | 123 | 56 | 55 | 25 | 55 | 25 |
| 7 | 164.0 | 149.1 | .035 | .008 | 140 | 64 | 126 | 59 | 0.77 | .35 | 67 | 30 | 59 | 27 | 59 | 27 |
| 8* | 237.7 | 216.1 | .075 | .008 | 340 | 154 | 306 | 139 | 1.29 | .59 | 241 | 109 | 65 | 30 | 65 | 30 |
| 9* | 196.1 | 119.3 | .041 | .005 | 231 | 105 | 208 | 94 | 1.06 | .48 | 107 | 49 | 101 | 46 | 66 | 30 |
| 10 | 131.2 | 119.3 | .036 | .009 | 119 | 54 | 107 | 49 | 0.82 | .37 | 54 | 25 | 53 | 24 | 66 | 30 |
| 11* | 173.3 | 157.6 | .050 | .005 | 250 | 114 | 225 | 102 | 1.30 | .59 | 118 | 54 | 107 | 49 | 72 | 33 |
| 12* | 172.1 | 156.5 | .055 | .009 | 200 | 91 | 180 | 82 | 1.04 | .47 | 120 | 54 | 60 | 27 | 73 | 33 |
| 13* | 180.0 | 163.7 | .045 | .012 | 132 | 60 | 119 | 54 | 0.66 | .30 | 90 | 41 | 29 | 13 | 74 | 34 |
| 14 | 219.3 | 199.4 | .090 | .008 | 391 | 178 | 352 | 160 | 1.61 | .73 | 272 | 123 | 80 | 36 | 80 | 36 |
| 15 | 184.0 | 167.3 | .080 | .009 | 295 | 134 | 266 | 121 | 1.45 | .66 | 198 | 90 | 68 | 31 | 81 | 37 |
| 16* | 117.9 | 107.2 | .044 | .006 | 195 | 89 | 176 | 80 | 1.49 | .68 | 68 | 31 | 108 | 49 | 83 | 38 |
| 17 | 181.5 | 165.0 | .058 | .007 | 300 | 136 | 270 | 123 | 1.49 | .68 | 140 | 64 | 130 | 59 | 120 | 55 |
| 18 | 194.6 | 176.9 | .040 | .009 | 225 | 102 | 203 | 92 | 1.04 | .47 | 91 | 41 | 112 | 51 | 125 | 57 |
| 18 | 179.7 | 163.4 | .084 | .013 | 292 | 133 | 263 | 119 | 1.46 | .66 | 193 | 88 | 70 | 32 | 125 | 57 |
| 20 | 204.4 | 185.9 | .041 | .013 | 180 | 82 | 162 | 74 | 0.79 | .36 | 87 | 39 | 75 | 34 | 130 | 59 |
| 21* | 216.9 | 197.3 | .054 | .012 | 250 | 114 | 225 | 102 | 1.04 | .47 | 138 | 63 | 87 | 39 | 132 | 60 |
| 22* | 155.4 | 141.3 | .085 | .011 | 320 | 145 | 288 | 131 | 1.85 | .84 | 174 | 78 | 114 | 52 | 149 | 68 |
| 23 | 228.6 | 207.9 | .067 | .012 | 350 | 159 | 315 | 143 | 1.38 | .63 | 190 | 82 | 125 | 57 | 170 | 77 |
| 24 | 138.5 | 126.0 | .049 | .010 | 350 | 159 | 315 | 143 | 2.27 | 1.03 | 82 | 37 | 233 | 106 | 258 | 117 |
| 25 | 228.4 | 207.3 | .065 | .010 | 525 | 238 | 473 | 215 | 2.07 | .94 | 190 | 86 | 283 | 128 | 307 | 139 |
| 26 | 193.5 | 176.0 | .083 | .013 | 542 | 246 | 488 | 222 | 2.52 | 1.14 | 205 | 93 | 283 | 128 | 338 | 153 |
| 27 | 209.5 | 190.5 | .061 | .013 | 528 | 240 | 475 | 216 | 2.27 | 1.03 | 152 | 69 | 323 | 147 | 378 | 172 |

*Present invention

TABLE III

| Heat | Torpedo Car Slag Compositions - Weight Percent | | | | | |
|---|---|---|---|---|---|---|
| | CaO | MgO | $SiO_2$ | $Al_2O_3$ | MnO | "K" Ratio |
| 1* | 53.9 | 6.9 | 23.1 | 6.2 | .9 | 1.51 |
| 2* | 47.6 | 6.1 | 32.6 | 9.0 | .8 | 1.02 |
| 3* | 46.9 | 6.8 | 23.9 | 6.3 | .5 | 1.28 |
| 4* | 44.1 | 8.9 | 33.7 | 6.7 | 1.8 | .93 |
| 5* | 47.0 | 8.3 | 29.2 | 10.4 | .8 | 1.00 |
| 6* | 43.8 | 9.5 | 23.4 | 6.4 | 1.6 | 1.16 |
| 7 | 39.8 | 7.6 | 39.1 | 10.3 | .8 | .71 |
| 8* | 54.9 | 7.7 | 27.1 | 5.3 | .5 | 1.38 |
| 9* | 45.4 | 8.2 | 25.8 | 13.4 | .9 | .98 |
| 10 | 39.7 | 18.0 | 31.8 | 5.3 | .4 | .73 |
| 11* | 58.4 | 6.8 | 19.5 | 3.9 | 1.0 | 1.97 |
| 12* | 45.0 | 9.9 | 29.3 | 6.8 | .8 | 1.00 |
| 13* | 40.0 | 7.7 | 32.9 | 11.1 | 2.2 | .82 |
| 14 | 37.2 | 13.3 | 34.3 | 7.2 | 1.6 | .71 |
| 15* | 29.0 | 12.8 | 44.1 | 7.3 | 2.3 | .49 |
| 16* | 57.4 | 4.5 | 20.6 | 4.7 | .5 | 1.94 |
| 17 | 36.3 | 17.2 | 32.4 | 8.3 | .6 | .64 |
| 18 | 38.9 | 7.4 | 39.7 | 5.7 | 2.3 | .78 |
| 19 | 38.4 | 15.3 | 35.0 | 6.6 | 1.4 | .70 |
| 20 | 38.9 | 14.6 | 29.4 | 7.5 | .7 | .77 |
| 21* | 42.3 | 15.4 | 29.5 | 7.4 | 1.1 | .83 |
| 22* | 43.0 | 8.4 | 37.3 | 8.6 | 1.0 | .81 |
| 23 | 35.4 | 14.8 | 38.0 | 7.4 | .9 | .60 |
| 24 | 25.8 | 11.3 | 50.8 | 5.2 | 2.4 | .42 |
| 25 | 22.8 | 16.4 | 42.7 | 11.3 | 1.8 | .35 |
| 26 | 24.5 | 22.7 | 36.1 | 8.3 | 1.2 | .38 |
| 27 | 40.6 | 10.3 | 37.2 | 7.9 | 1.2 | .75 |

*Present invention $$\text{"K" ratio} = \frac{CaO + MnO}{SiO_2 + Al_2O_3 + MgO}$$

What is claimed is:

1. In a process of desulfurizing a molten ferrous metal charge by magnesium addition prior to refining said charge in an oxygen steel converter, wherein said molten charge is tapped into a transfer vessel, emptied therefrom into a ladle for charging into said converter, and magnesium is added to said charge for desulfurization in one of said transfer vessel and said ladle, the improvement which comprises adding a calcium compound to said charge, adding fluxing agents along with said calcium compound in an amount sufficient to dissolve said calcium compound and to form with silica in said charge a fluid, high sulfur capacity slag wherein the weight ratio of calcium oxide to silica plus at least one of $Al_2O_3$ and MgO is greater than 0.8, thereafter adding magnesium to said charge, and causing sulfur removed from said charge by said magnesium addition to be transferred to and retained by said slag.

2. The improvement of claim 1, wherein said calcium compound is at least one of lime, calcium carbonate, calcium fluoride, calcium chloride, limestone, dolomitic limestone, and burnt dolomite.

3. The improvement of claim 1, wherein the amount of said calcium compound added to said charge is proportioned to the anticipated silica content of said charge in such manner that the weight ratio of dissolved calcium oxide to silica and at least one of $Al_2O_3$ and MgO in said slag is greater than 1.0.

4. The improvement of claim 1, wherein said fluxing agents contain at least one of lime,.alumina, fluorspar, aluminum and silica in proportions such that % CaO + % MnO/% $Al_2O_3$ + % $SiO_2$ + % MgO in said slag is greater than 0.8.

5. The improvement of claim 1, wherein said calcium compound and said fluxing agents are added to said transfer vessel before tapping said charge thereinto.

6. The improvement of claim 5, wherein magnesium is added to said transfer vessel after tapping said charge thereinto.

7. The improvement of claim 5, wherein magnesium is added to said ladle after filling thereof with said charge and slag.

8. The improvement of claim 1, wherein the amounts of said calcium compound and fluxing agents are proportioned to provide a composition within the ranges of about 60% to 90% calcium compound, up to 35% alumina, up to 15% fluorspar, and up to about 5% silica, by weight.

9. The improvement of claim 1, wherein said fluid, high sulfur capacity slag contains, in weight percent, about 40% to 55% calcium oxide in dissolved form, about 5% to 15% magnesium oxide, about 5% to 12% alumina, about 20% to 35% silica, and small amounts of manganese oxide and alkali metal oxides.

10. The improvement of claim 1, wherein said magnesium is added in admixture with at least one of calcium oxide, calcium fluoride, calcium carbide and carbon.

11. The improvement of claim 1, wherein said charge contains at least 0.01% dissolved aluminum.

12. The improvement of claim 1, including the step of stirring said charge in said transfer vessel with an inert gas prior to addition of magnesium whereby to reduce dissolved oxygen in said charge and provide a non-oxidizing atmosphere above the surface of said slag.

13. A process for magnesium desulfurization of a ferrous metal melt with improved efficiency in magnesium consumption and substantial elimination of sulfur reversion, comprising the steps of providing a flux in a transfer vessel into which said melt is tapped, said flux containing a calcium compound and at least one of aluminum, alumina, fluorspar and silica in proportions such that a fluid, high sulfur capacity slag is formed in said vessel after tapping in which substantially all of said calcium compound is dissolved and wherein the weight ratio of slag constituents associated with sulfur to slag constituents associated with oxygen is greater than 0.8, thereafter injecting magnesium into said melt in an amount sufficient to desulfurize said melt by formation of magnesium sulfide particles, and causing said sulfide particles to be removed from said melt.

14. The process of claim 13, wherein said calcium compound is at least one of lime, calcium carbonate, calcium fluoride, calcium chloride, limestone, dolomitic limestone, and burnt dolomite.

15. The process of claim 13, wherein the amount of said calcium compound is proportioned to the anticipated silica content of said melt in such manner that the weight ratio of calcium oxide+MnO to silica+$Al_2O_3$+MgO in said slag is greater than 1.0.

16. The process of claim 13, wherein the amounts of said calcium compound and at least one of alumina, aluminum, fluorspar and silica are proportioned to provide a flux within the ranges of about 60% to 90% calcium compound, up to 35% alumina, up to 15% fluorspar, and up to about 5% silica, by weight.

17. The process of claim 13, wherein said fluid, high sulfur capacity slag contains, in weight percent, about 40% to 55% calcium oxide in dissolved form, about 5% to 15% magnesium oxide, about 5% to 12% alumina, about 20% to 35% silica, and small amounts of manganese oxide and alkali metal oxides.

18. The process of claim 13, wherein said melt and said slag are emptied from said transfer vessel into a ladle for charging into an oxygen converter.

19. The process of claim 18, wherein magnesium is added to said transfer vessel before emptying thereof into said ladle.

20. The process of claim 18, wherein magnesium is added to said ladle after filling thereof with said melt and slag.

21. The process of claim 13, wherein said magnesium sulfide particles are caused to collect at the interface between said melt and slag and to dissociate in contact with said slag whereby sulfide ions react with and are retained by said slag.

22. The process of claim 13, wherein said magnesium is injected in admixture with at least one of calcium oxide, calcium fluoride, calcium carbide and carbon.

23. The process of claim 13, wherein said melt contains at least 0.01% dissolved aluminum.

24. The process of claim 13, including the step of stirring said melt in said transfer vessel with an inert gas prior to injection of magnesium whereby to reduce dissolved oxygen in said melt and provide a non-oxidizing atmosphere above the surface of said slag.

* * * * *